United States Patent [19]

Takahashi et al.

[11] 4,104,978

[45] Aug. 8, 1978

[54] PROTECTIVE DEVICE IN A MOTOR-OPERATED SEWING MACHINE

[75] Inventors: Tadashi Takahashi; Shigeki Morinaga; Kuniaki Kubokura, all of Ibaraki, Japan

[73] Assignee: Hitachi, Ltd., Japan

[21] Appl. No.: 806,154

[22] Filed: Jun. 13, 1977

[30] Foreign Application Priority Data

Jun. 12, 1976 [JP] Japan ..... 51-68227

[51] Int. Cl.[2] ..... D05B 69/36

[52] U.S. Cl. ..... 112/277; 112/300; 192/129 A

[58] Field of Search ..... 112/277, 275, 300, 121.11, 112/220, 221; 192/129 A; 318/62, 272

[56] References Cited

U.S. PATENT DOCUMENTS

| | | | |
|---|---|---|---|
| 3,157,261 | 11/1964 | Bono | 112/300 X |
| 3,573,581 | 4/1971 | Dutko et al. | 112/275 |
| 3,757,232 | 9/1973 | Matsuda | 112/275 |
| 3,858,095 | 12/1974 | Friemann | 192/129 A |

*Primary Examiner*—Peter Nerbun
*Attorney, Agent, or Firm*—Craig & Antonelli

[57] ABSTRACT

In a protective device for controlling a sewing machine at a predetermined number of revolutions by a motor equipped with a clutch mechanism and a brake mechanism which are electromagnetically actuated, a protective device is constructed comprising a detector to detect substantially the rotation of the driving shaft of the sewing machine, and a detector to detect the voltage of a control circuit with an output from the detectors being compared with a reference value representative of a predetermined driving state for the sewing machine, so that when the output of the detector becomes lower than the reference value, the operation of the control circuit is terminated, whereby safe operation is provided for the apparatus and an operator.

10 Claims, 9 Drawing Figures

PROTECTIVE DEVICE IN A MOTOR-OPERATED SEWING MACHINE

Figure 1:
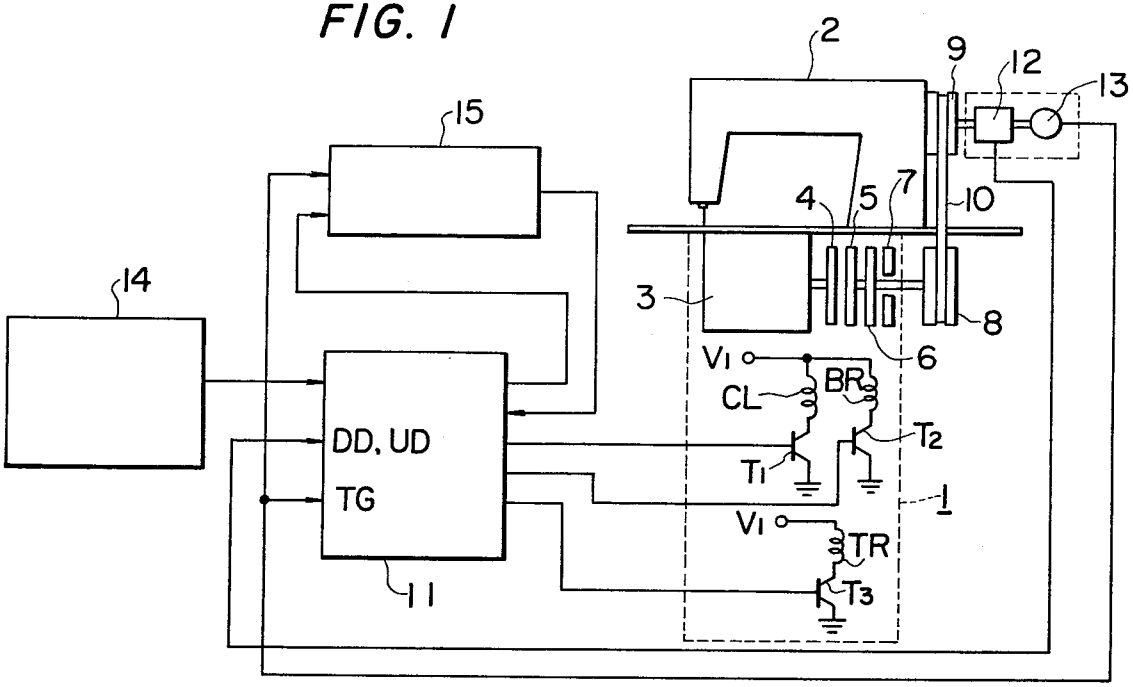

This invention relates to a driving device for an industrial sewing machine. More particularly, it relates to a protective device for an industrial motor-operated sewing machine which is driven and controlled at a predetermined number of revolutions by a clutch motor equipped with a clutch mechanism and a brake mechanism each being electromagnetically actuated.

Control devices for motor-operated sewing machines have been contemplated, as, for example, in U.S. Pat. No. 3,761,790. In this prior device, a motor shaft normally rotates at a predetermined number of revolutions, and has a flywheel attached thereto. A clutch disc is mounted to an output or driven shaft, and a pulley is fixed to an end of the output shaft.

Upon actuation of a clutch winding, the clutch disc is engaged with the flywheel to transmit the rotation of the motor shaft to the pulley. On the other hand, when a brake winding is energized, the clutch disc is disengaged from the flywheel, and simultaneously, it is pressed into contact with a brake friction disc so as to brake the output shaft. Accordingly, the pulley fixed to the output shaft is rotated or stopped by actuating the clutch disc against either the flywheel or the brake friction disc.

Since the turning force is transmitted from the pulley to the machine shaft of the sewing machine proper through coupling means such as a belt, the rotation of output shaft through the clutch disc rotates the machine shaft.

On the other hand, the machine shaft is additionally provided with a position detector for detecting the vertical position of the sewing machine needle, and a speed detector for detecting the number of revolutions (rotational speed) of the machine shaft. Outputs from these detectors are fed back, as the input signals of a control unit, for energizing and controlling the clutch coil and the brake coil.

As previously stated, movements of the clutch disc are such that the clutch disc is pressed against the flywheel by energizing the clutch coil, while it is pressed against the brake friction disc to apply the brake by energizing the brake coil. The sewing machine can therefore be operated or stopped by controlling the conduction of current to the clutch coil and the brake coil.

Recent industrial sewing machines are highly advanced. The mechanism of an automatic thread cutter, for example, is provided in addition to the foregoing construction, and the control is much more complicated. For this reason, a logical circuit in the form of an IC (integrated circuit) is often used as a control circuit. Although the IC logical circuit includes many types, such as TTL (Transistor-Transistor-logic) or CMOS (Complementary MOS), especially the TTL, are extensively adopted for considerations of low cost, etc.

For the IC logical circuits, operating supply voltages are not restricted, and particularly in a low voltage region, the operation is unstable. Generally, in the case of the TTL, operation is not warranted at a voltage below 4.75 V.

In the control circuit for a sewing machine which employs such an IC logical circuit, the IC logical circuit can malfunction at the rise or fall of the supply voltage due to the turn-on or turn-off of a power source.

Concretely, when the control circuit of the sewing machine is such that the transistors are controlled by outputs from the IC logical circuit, so as to operate the clutch coil, the brake coil and the automatic thread cutter, the machine will malfunction at the turn-on or turn-off of the power source, interruption of service for the power source, etc. occurs.

Further, sewing machines are operated by humans, and because of the use of a needle, it is therefore very dangerous when the needle breaks or scatters on account of a surge or sudden drive of the sewing machine, or an unexpected actuation of the automatic thread cutter resulting from a malfunction.

In addition, sewing machines are often turned over for adjustments, 1f, during the adjustments, a pedal is erroneously or accidentally manipulated, an a thread signal is inputted, the automatic thread cutter will be energized simultaneously with an energization of the clutch coil.

However, when the sewing machine is turned over, the belt which couples the output shaft of the motor and the machine shaft is loose, so that the machine shaft is not driven and no output signal from the position detector is fed back to the control unit. Therefore, the clutch coil and the coil of the automatic thread cutter are held energized for a long time. Since, in general, the automatic thread cutter is normally used only for an extremely short period of time, and is set at a short time rating, then, when it is energized for a long time, the coil becomes overheated and burns-out.

Moreover, when the machine proper is returned to its normal or ordinary position without knowing that the respective coils are in the energized states, as stated above, the automatic thread cutter is sometimes actuated simultaneously.

In a case where the sewing machine has been placed into a locked state, or an overload occurs during drive by any case, it does not reach the predetermined number of revolutions in spite of the fact that a machine drive command is given to the motor. Therefore, a large current flows through the motor so as to rotate at a higher speed. If such situation is allowed to continue for a long time, the motor will burnout.

As described above, recent industrial sewing machines have many complicated control mechanisms. Moreover, the controls are carried out manually by an operator, especially women, and therefore, a safety device for protecting the personal safety of the operator, as well as the apparatus, has been long needed.

The present invention has been made to overcome and alleviate these problems stated above, and provides a protective device to sense a malfunctional state for a sewing machine, and to automatically stop the operation of the sewing machine, such as to protect the sewing machine and the operator from danger.

In general, this invention provides protective means for automatically making a clutch activating signal and a thread cutting signal ineffective by generating a stop signal upon sensing the fact that a rotation signal of the sewing machine is below a reference signal.

Still another object of this invention is to provide protective means for preventing a malfunction of the control circuit which may be attributed to a fluctuation in the supply voltage.

The principal feature of this invention comprises a clutch motor which is equipped with a clutch mechanism and a brake mechanism, each being electromagnetically actuated, a mechanism which drives a sewing machine by the motor, a mechanism which detects the rotation of the sewing machine shaft, an electrical control unit which controls the operations of the clutch and the brake of the motor, and a protective circuit which terminates the operation of the sewing machine through the control unit upon sensing the fact that a rotation signal of the sewing machine shaft is below a reference signal.

Figure 2:
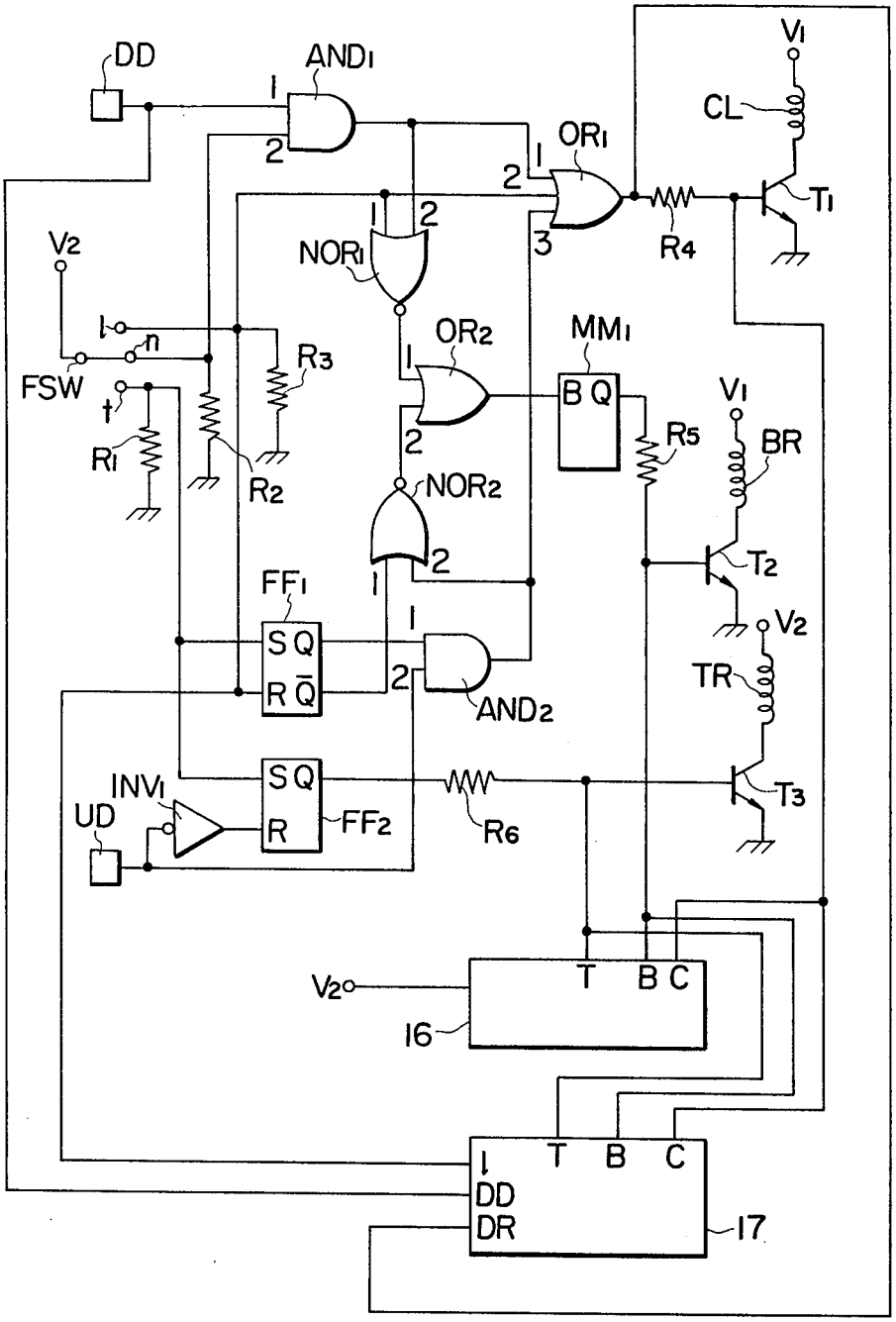
Figure 3:
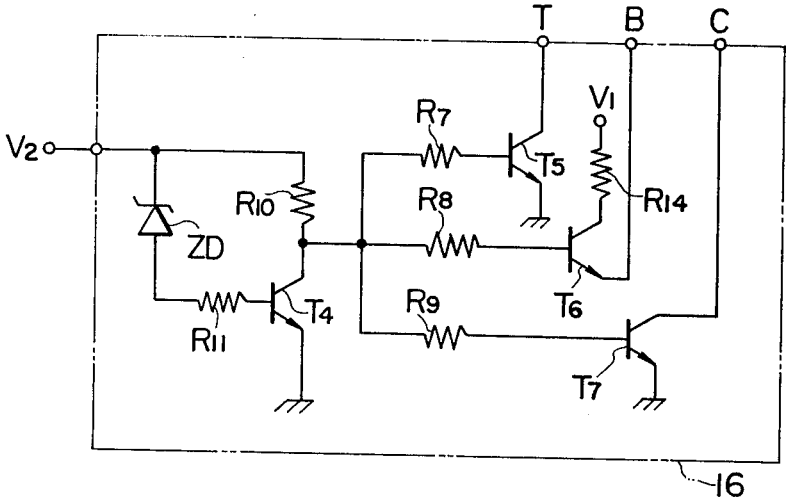
Figure 4:
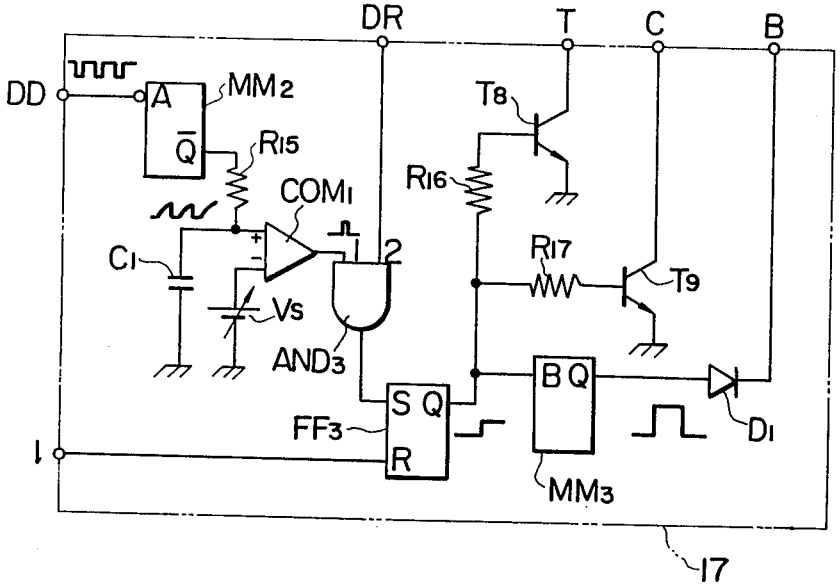
Figure 5:
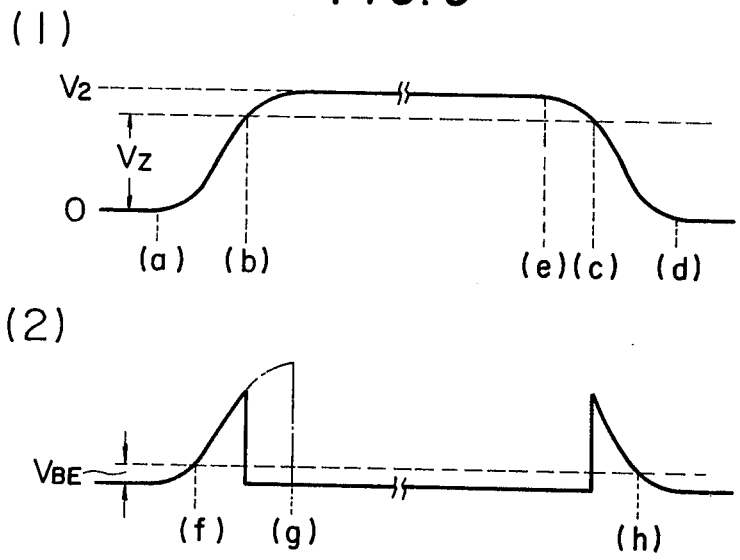
Figure 6:
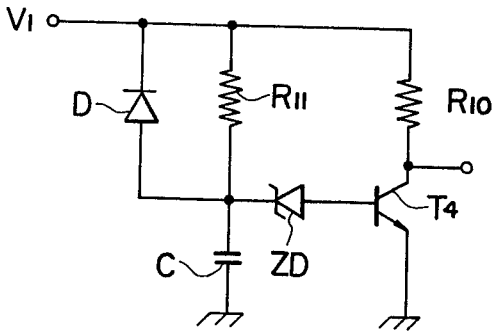
Figure 7:
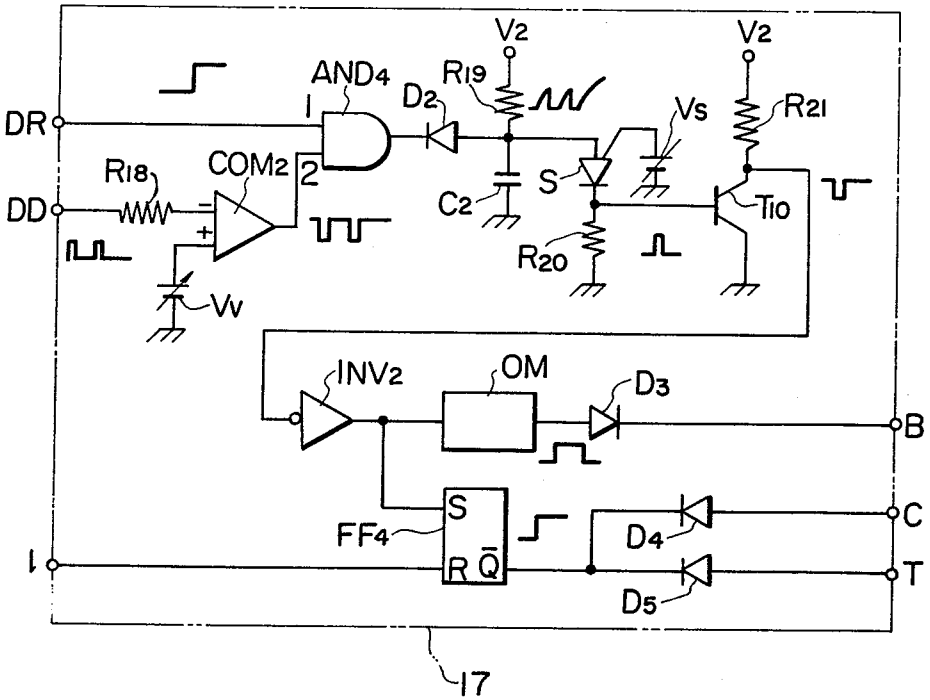
Figure 8A:
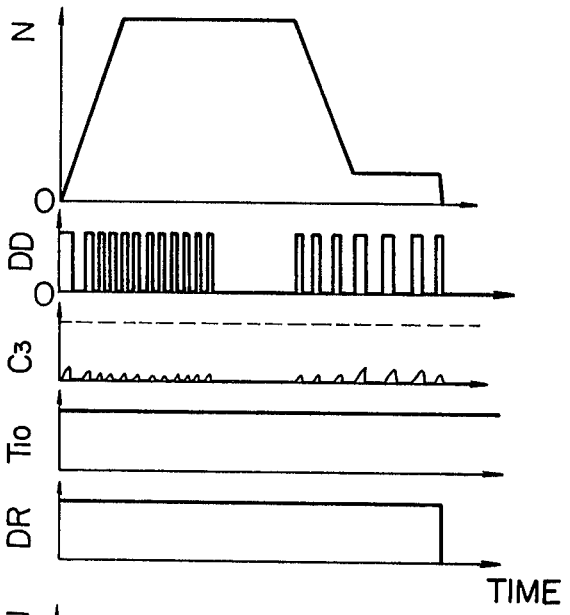
Figure 8B:
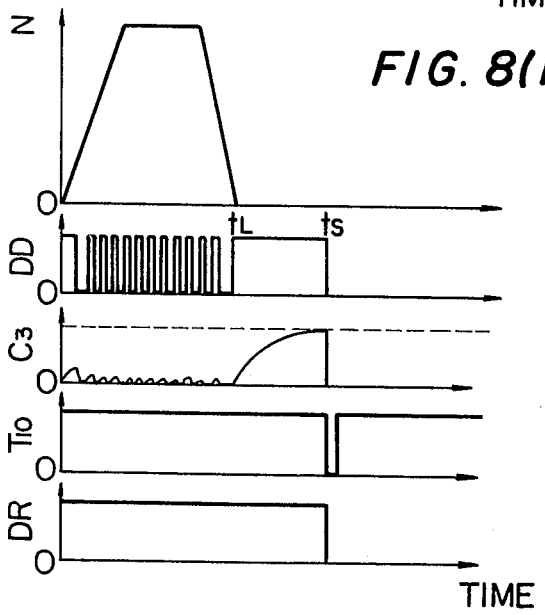

These and other objects, features and advantages of the present invention will become more apparent from the following description when taken in connection with the accompanying drawings which show, for purposes of illustration only, several embodiments in accordance with the present invention, and wherein:

FIG. 1 is a block diagram showing a control device for a motor-operated sewing machine according to this invention, FIG. 2 is a connection diagram showing an embodiment of this invention, FIG. 3 is a connection diagram showing the details of the voltage protective device in FIG. 2, FIG. 4 is a connection diagram of the lock protective device in FIG. 2, FIG. 5 is a diagram for explaining the rise and fall of the voltages, FIG. 6 is a connection diagram showing the essential portions of another embodiment of the voltage protective device, FIG. 7 is a connection diagram of another embodiment of the lock protective device, and FIGS. 8*a*, 8*b* are diagrams for explaining the operation of the embodiment of FIG. 7.

FIG. 1 is a block diagram of a device constructed according to this invention. As shown in the figure, a motor-operated sewing machine consists of a clutch motor 1 and a sewing machine 2 which is driven by the motor 1.

The clutch motor 1 has a clutch friction disc 4 which is fixed to a flywheel and a clutch disc 5. A brake disc 6 and a brake friction disc 7 are arranged in opposition to the clutch friction disc 4. A pulley 8 is mounted on one end of an output shaft and the clutch disc 5 attached to the output shaft. A pulley 9 is mounted on the shaft of the sewing machine 2 and is coupled by a belt 10 to pulley 8.

Further, the clutch motor 1 has a clutch coil CL which is arranged in proximity to the clutch disc 5, a brake coil BR which is arranged in proximity to the brake disc 6, and a thread cutting coil TR which serves to actuate an automatic thread cutter. The respective coils are energized and controlled by a control unit 11 through transistors $T_1$, $T_2$ and $T_3$.

On the other hand, a position detector 12 for detecting the vertical position of the needle of the sewing machine, and a speed detector (for example, speed generator TG) 13 for detecting the number of revolutions of the machine are attached to the shaft of the sewing machine 2. Outtputs from the position detector 12 and the speed detector 13 are applied as control inputs to the control unit 11.

A command unit 14 which is directly coupled to the pedal of the sewing machine serves to drive the shaft of the sewing machine at a predetermined number of revolutions. A protector unit 15 which detects the rotation of the sewing machine 2, or the fluctuation of a supply voltage, impresses a predetermined protection command signal on the control unit 11.

In the construction as stated above, when a machine drive command is issued by the command unit 14, the clutch coil CL is energized through the control unit 11, the clutch disc 5 engages the clutch friction disc 4, and the output of the motor 3 drives the pulley 9 through the clutch disc 5, pulley 8 and belt 10, so that the sewing machine is rotated. At this timee, the number of revolutions or rotational speed of the machine shaft is detected, and the output is fed back to the control unit 11 so as to drive the shaft at a preset number of revolutions.

For stopping the sewing machine, the brake coil BR is energized, the brake disc 6 engages the brake friction disc 7, and the rotation of the pulley 8 is stopped.

Now, the control device of this invention will be described with reference to circuit diagrams of FIGS. 2 - 4 and an operating waveform diagram of FIG. 5.

In FIG. 2, CL and BR indicate the clutch coil and the brake coil as in FIG. 1, respectively. TR indicates the driving coil for the automatic thread cutter.

The collector of the transistor $T_1$ is connected to the positive pole of a power source $V_1$ through the clutch coil CL. Likewise, the collectors of the transistors $T_2$ and $T_3$ are connected to the positive pole side of the power source $V_1$ through the brake coil BR and the thread cutting coil TR, respectively. On the other hand, the emitters of the transistors $T_1$ – $T_3$ are grounded.

The base of the transistor $T_1$ is connected to the C-terminals of a voltage protective circuit 16 and a lock protective circuit 17 to be described later, and is also connected through a resistance $R_4$ to the output end of an OR gate circuit (hereinbelow, simply termed "OR gate") $OR_1$ and the DR-terminal of the lock protective circuit 17.

The base of the transistor $T_2$ is connected to the B-terminals of the voltage protective circuit 16 and the lock protective circuit 17, and is also connected through a resistance $R_5$ to the output end Q of a monostable multivibrator $MM_1$.

Further, the base of the transistor $T_3$ is connected to the T-terminals of the voltage protective circuit 16 and the lock protective circuit 17. It is also connected through a resistance $R_6$ to the output Q of a flip-flop $FF_2$.

FSW denotes a foot switch which interlocks with the pedal. When the foot switch FSW is moved forward, a movable member connected to a supply voltage for control circuitry, $V_2$ (hereinbelow, simply termed "power source $V_2$"), is connected to a terminal l. When it is moved backward, the movable member is connected to a terminal *t*. Further, when it is made neutral, the movable piece is connected to a terminal *n*.

DD denotes a lower position detector which detects the lower position of the sewing machine needle and whose output becomes L (low level) when the needle lies at the lower position. UD denotes an upper position detector for the sewing machine needle, the output of which becomes L when the needle lies at the upper position.

The output of the lower position detector DD is connected to the DD-terminal of the lock protective circuit 17, and is also connected to one input 1 of an AND gate $AND_1$. The other input 2 of the AND gate $AND_1$ is connected to the terminal *n* of the foot switch FSW and to ground through a resistance $R_2$.

The output of the AND gate $AND_1$ is connected to the input 1 of the OR gate $OR_1$ and the input 2 of a NOR gate $NOR_1$. The input 1 of the NOR gate $NOR_1$ is respectively connected to the input 2 of the OR gate $OR_1$, the terminal l of the foot switch FSW and one end of a resistance $R_3$. Further, the input 1 of the NOR gate $NOR_1$ is connected to the reset terminal R of a flip-flop $FF_1$ and the terminal l of the lock protective circuit 17. The other end of the resistance $R_3$ is grounded for connection to the negative pole of the power source $V_2$.

The outputt of the NOR gate $NOR_1$ is connected to the input 1 of an OR gate $OR_2$, the input 2 of which is connected to the output of a NOR gate $NOR_2$. The output of the OR gate $OR_2$ is connected to the input B of the monostable multivibrator $MM_1$.

The input 1 of the NOR gate $NOR_2$ is connected to the output $\overline{Q}$ of the flip-flop $FF_1$. The input 2 thereof is connected to the input 3 of the OR gate $OR_1$ and to the output side of an AND gate $AND_2$.

The input 1 of the AND gate $AND_2$ is connected to the output Q of the flip-flop $FF_1$, and the input 2 thereof is connected to the input of an inverter $INV_1$, as well as the upper position detector UD.

The output of the inverter $INV_1$ is connected to the reset terminal R of the flip-flop $FF_2$. Both the set terminals S of the flip-flops $FF_1$ and $FF_2$ are connected to one end of a resistance $R_1$ and the terminal *t* of the foot switch FSW. The other end of the resistance $R_1$ is grounded.

As shown in FIG. 3, the voltage protective circuit 16 is such that a series circuit consisting of a zener diode ZD, a resistance $R_{11}$ and the base-emitter circuit of a transistor $T_4$ is connected between the positive pole side of the power source $V_2$ and the negative pole side thereof.

Resistances $R_7 - R_{10}$ are connected to the collector of the transistor $T_4$. The end of the resistance $R_{10}$ remote from the collector of the transistor $T_4$ is connected to the power source $V_2$, and the ends of the resistances $R_7 - R_9$ remote from the same are respectively connected to the bases of transistors $T_5 - T_7$.

The emitters of the transistors $T_5$ and $T_7$ are grounded, and the collectors are respectively connected to the T- and C-terminals. Further, the emitter of the transistor $T_6$ is connected to the B-terminal, while the collector is connected to the power source $V_2$ through a resistance $R_{14}$.

FIG. 4 illustrates the lock protective means 17. The DD-terminal connected to the lower position detector DD (FIG. 2) is connected to the input A of the monostable multivibrator $MM_2$, the output terminal $\overline{Q}$ of which is connected through a resistance $R_{15}$ to the positive side input end of a comparator $COM_1$ along with a capacitor $C_1$.

A reference voltage $V_2$ is applied to the negative side input of the comparator $COM_1$, the output of which is connected to the input 1 of an AND gate $AND_3$.

The input 2 of the AND gate $AND_3$ is connected to the drive signal terminal DR which in turn is connected to the output end of the OR gate $OR_1$ (FIG. 2) providing the drive signal of the clutch coil CL.

The output of the AND gate $AND_3$ is connected to the set terminal S of a flip-flop $FF_3$, while the reset terminal R of the flip-flop $FF_3$ is connected to the terminal l of the foot switch FSW.

Further, the output terminal Q of the flip-flop $FF_3$ is connected to the bases of transistors $T_8$ and $T_9$ through resistances $R_{16}$ and $R_{17}$ respectively. It is also connected to the B-terminal of a monostable multivibrator $MM_3$.

The collector of the transistor $T_8$ is connected to the base of the transistor $T_3$ through the T-terminal. The collector of the transistor $T_9$ is connected to the base of the transistor $T_1$ through the C-terminal.

On the other hand, the output Q of the monostable multivibrator $MM_3$ is connected through a diode $D_1$ and the B-terminal to the base of the transistor $T_2$ which actuates the brake coil BR.

The device of this invention constructed as described above operates as stated below.

Now, there will be explained in detail the state in which the power source has been turned "on" and the voltage $V_2$ being the supply voltage for the IC logical circuit has sufficiently risen.

The voltage of the zener diode ZD is selected to be close to the lowest operating voltage of the IC in advance. Under the specified state, therefore, the transistor $T_4$ becomes conductive through the zener diode ZD and the resistance $R_{11}$, and its collector potential becomes substantially zero. Consequently, all the transistors $T_5 - T_7$ become "off", and the clutch coil CL, brake coil BR and automatic thread cutting coil TR operate by the outputs of the IC logical circuit.

Here, the foot switch FSW is moved forward to bring the contact l into H (high level). Then, the input 2 of the OR gate $OR_1$ becomes H, and also the output becomes H. Therefore, the transistor $T_1$ is rendered conductive to energize the clutch coil CL, so that the sewing machine is driven as explained with reference to FIG. 1. Since the contact *n* of the foot switch FSW is at L (low level), the output of the AND gate $AND_1$ becomes L, and the input 1 of the NOR gate $NOR_1$ is at H, the input 2 is at L and the output is at L. Since the outputs Q of the flip-flops $FF_1$ and $FF_2$ are at L and the outputs $\overline{Q}$ are at H, the input 1 of the NOR gate $NOR_2$ becomes H and the output becomes L. Therefore, also the ouput of the OR gate $OR_2$ becomes L and the output Q of the monostable multivibrator MM becomes L, so that the brake coil BR is not energized. The automatic thread cutting coil TR is not energized either because the output Q of the flip-flop $FF_2$ is at L.

Under this state, the input 2 of the AND gate $AND_3$ in FIG. 4 is at the H level. Since, however, the sewing machine is operating, the lower position signal DD is continuously produced, the duty of the output $\overline{Q}$ of the monostable multivibrator $MM_2$ is small, and the + input of the comparator $COM_1$ as smoothed by the resistance $R_{15}$ and the capacitor $C_1$ is smaller than the reference voltage $V_s$, so that the output of the comparator $COM_1$ is at the L level. Therefore, the output of the AND gate $AND_3$ becomes the L level, and no signal enters the set input S of the flip-flop $FF_3$, so that the output Q thereof becomes the L level and that the transistors $T_8$, $T_9$ and the monostable multivibrator $MM_3$ do not operate.

Subsequently, when the foot switch FSW has the movable member connected to the neutral contact *n*, the input 2 of the OR gate $OR_1$ becomes L, but the *n* contact of the foot switch FSW becomes H. Therefore, the input 2 of the AND gate $AND_1$ is at H, the input 1 is at H until the lower position of the needle is reached, and the output becomes. H. Consequently, the input 1 of the OR gate $OR_1$ becomes H and the output becomes H, so that the clutch coil CL continues to be energized. Accordingly, the sewing machine rotates. When the needle comes to the lower position, the output of the lower position detector DD becomes L, and also the output of the AND gate $AND_1$ becomes L. In consequence, all the inputs 1 - 3 of the OR gate $OR_1$ become L, and the clutch coil CL is prevented from being energized. Simultaneously therewith, both the inputs 1 and 2 of the NOR gate $NOR_1$ become L and the output becomes H. Then, the monostable multivibrator $MM_1$ operates during a certain period of time, to energize the brake coil BR, to apply the brake and to stop the sewing machine at the lower position. Since, at this time, the outputs of the flip-flops $FF_1$ and $FF_2$ do not change, the NOR gate $NOR_2$ and the ANd gate $AND_2$ are the same as before, and the automatic thread cutting coil TR is not energized either.

Further, when the foot swich FSW is moved backward, the movable member touches the contact *t*. Since the set terminals S of the flip-flops $FF_1$ and $FF_2$ become H, the output Q becomes H and the output $\overline{Q}$ becomes L. Then, the automatic thread cutting coil TR is energized to get ready for the thread cutting. Simultaneously therewith, both the inputs 1 and 2 of the AND gate $AND_2$ become H and the output becomes H, and the imput 3 of the OR gate $OR_1$ becomes H and the output becomes H. Then, the clutch coil CL is energized to drive the sewing machine. Therefore, the needle moves upwards, and the automatic thread cutting is done in the course of this movement. When the needle reaches the upper position, the output of the upper position detector UD becomes L and it renders the input 2 of the AND gate $AND_2$ the L level, so that the output thereof becomes L and the clutch coil CL is deenergized. Simultaneously therewith, the output of the NOR gate $NOR_2$ becomes H and also the output of the OR gate $OR_2$ becomes H, so that the monostable multivibrator $MM_1$ operates for a short time, to energize the brake coil BR and apply the brake and to stop the sewing machine at the upper position. In addition, the output of the inverter $INV_1$ becomes H. Therefore, the output Q of the flip-flop $FF_2$ becomes L, and the automatic thread cutting coil TR is deenergized, so that the thread cutting is completed.

As set forth above, the sewing machine executes the predetermined operations by the forward movement of the foot pedal, the movement to neutral and the backward movement of the pedal.

In a case where the sewing machine is in normal operation as stated above, the lower position signals DD enter continuously, and hence, the output $\overline{Q}$ of the monostable multivibrator $MM_2$ repeats the H level and the L level. The voltage integrated by the capacitor $C_1$ and the resistance $R_{15}$ in the period of the H level is smaller than the reference voltage $V_s$, and the charges stored in the capacitor $C_1$ are discharged through the resistance $R_{15}$ in the period of the L level, so that the output of the comparator $COM_1$ always becomes the L level.

Accordingly, the output of the AND gate $AND_3$ always becomes the L level, and the flip-flop $FF_3$ does not operate and its output Q does not become the H level. In consequence, the transistors $T_8$, $T_9$ and the monostable multivibrator $MM_3$ do not operate. Therefore, no influence is exerted on the clutch coil CL, the thread cutting coil TR and the brake coil BR.

In a case where the sewing machine turned over for adjustments, when the foot switch FSW is moved forward, the clutch drive signal DR is provided as in the foregoing, and hence, the pulley 8 directly coupled with the clutch disc 5 rotates. Since, however, the belt 10 is loose and the sewing machine shaft does not rotate, the lower position signal DD is not produced. Therefore, the output $\overline{Q}$ of the monostable multivibrator $MM_2$ is kept at the H level, the + input voltage of the comparator COM increases according to the time constant between the resistance $R_{15}$ and the capacitor $C_1$ and becomes greater than the reference voltage $V_s$, and the output thereof becomes the H level. Since also the clutch drive signal DR is at the H level, the output of the AND gate $AND_3$ becomes the H level, and the set terminal S of the flip-flop $FF_3$ becomes the H level. Therefore, the output of the flip-flop $FF_3$ becomes the H level, and the transistors $T_8$ and $T_9$ become conductive to short the base-emitter circuits of the transistors $T_1$ and $T_2$. Accordingly, the current of the clutch coil CL is cut off, and simultaneously, a signal is applied to the input B of the monostable multivibrator $MM_3$ so as to render the output Q thereof the H level for a certain time, thereby to energize the brake coil BR and to stop the sewing machine.

If the foot switch FSW is moved backward when the sewing machine is turned over, the flip-flops $FF_1$ and $FF_2$ in FIG. 2 operate as in the foregoing, and the clutch drive signal DR and the thread cutting signal are issued. Since, however, the belt 10 is loose, the sewing machine does not rotate, and the lower position signal DD in FIG. 4 is not generated. Accordingly, the output $\overline{Q}$ of the monostable multivibrator $MM_2$ is kept at the H level. As in the foregoing, the output of the comparator $COM_1$ becomes the H level, to set the flip-flop $FF_3$ and bring its output Q into the H level and to render the transistors $T_8$, $T_9$ conductive. Then, the clutch signal DR and the thread cutting signal are short-circuited to cut off the currents of the clutch coil CL and the thread cutting drive coil TR. Simulaneously therewith, the monostable multivibrator $MM_3$ is operated to hold the output Q thereof at the H level for a certain time. Thus, the brake signal is generated to stop the sewing machine.

Accordingly, even when this state continues, neither the thread cutting drive coil TR is burned-out, nor the thread cutting operation is carried out, so that safety is guaranteed.

By changing the values of the resistance $R_{15}$ and the capacitor $C_1$ and varying the time constant of the integral, it is possible to adjust and freely select the period of time in which after turning the sewing machine over and actuating the foot switch FSW, the signal of the comparator $COM_1$ becomes the H level and the clutch coil CL as well as the thread cutting coil TR becomes ineffective.

The number of revolutions of the sewing machine shaft at which the safty circuit of FIG. 4 operates can be freely adjusted be changing either the values of the resistance $R_{15}$ and the capacitor $C_1$ or the reference voltage $V_s$.

Even when the sewing machine is returned to its normal operating state from the state described above, it does not operate. In order to attain normal operation, after erecting the sewing machine, the foot switch is once moved forward to reset the flip-flop $FF_3$ in FIG. 4. Thus, the original normal operation is established.

The operation at the turn-on or turn-off of the power source will now be described in detail.

When the power source is turned on and off, the supply voltage $V_2$ rises and falls as illustrated at (1) in FIG. 5. At the turn-on of the power source, the supply voltage $V_2$ gradually rises from point (a), and reaches the voltage $V_z$ of the zener diode ZD at point (b). Since this voltage is selected to be close to the voltage at which the IC logical circuit operates, the operation of the IC logical circuit becomes normally established at the point (*b*). Between the points (*a*) and (*b*), accordingly, the operation of the IC logical circuit need be made ineffective. Originally, the clutch coil CL, the automatic thread cutting coil TR, etc. are not operated by voltages below the operating voltages of the transistors $T_1$ - $T_3$. For the above purpose, accordingly, the bases of the transistors $T_1$, $T_3$ may be short-circuited by the transistors $T_5$, $T_7$ whose operating voltages are sufficiently lower than that of the IC logical circuit.

In FIG. 5 (2), the collector voltage of the transistor $T_4$ is illustrated. After turn-on of the power source, the supply voltage $V_2$ for the IC logical circuit rises from the point (a) to the point (b), the collector voltage rises the same as the supply voltage $V_2$. However, when the voltage $V_z$ of the zener diode ZD is exceeded at the point (b), the transistor $T_4$ falls into the "on" state, and the collector potential thereo becomes substantially zero. At turn-off of the power source, when the supply voltage beomes lower than the voltage $V_z$ of the zener diode ZD, the trasistor $T_4$ turns off, and the collector voltage thereof lowers in the same shape as that of the supply voltage $V_2$ from point (c). The transistors $T_5$, $T_6$ and $T_7$ connected to the collector of the transistor $T_4$ operate until point (*b*) from point (*f*) at which the potential in FIG. 5 (2) becomes greater than the base-emitter forward voltages $V_{BE}$ of the transistors. Between point (*f*) and point (*b*), accordingly, the transistors $T_1$ and $T_3$ are short-circuited to prevent the clutch coil CL and the automatic thread cutting coil TR from operating. During this period, the transistor $T_2$ is operated by the transistor $T_6$ to energize the brake coil BR and brake the sewing machine to prevent a malfunction.

In cases of low voltages between the points (*a* ) and (*f*) and between points (*h*) and (*d*), the outputs of the respective IC logical circuits are below the supply voltage $V_2$, and the potential becomes below the base-emitter forward voltages $V_{BE}$ of the transistors $T_1$, $T_3$. It is accordingly understood that no malfunction occurs.

In case of service interrruption, the same consideration as that between the points (*e*) and (*d*) in FIG. 5 (1) applies, and it is similarly possible to avoid a malfunction and to prevent danger.

Shown in FIG. 6 is another embodiment. The same symbols as in FIG. 3 indicate parts which carry out similar operations.

The collector and emitter of a transistor $T_4$ are connected in the same manner as in FIG. 3, while the base is connected through a zener diode ZD to a resistance $R_{11}$, a capacitor C and the anode side of a diode D. The cathode of the diode D and the end of the resistance $R_{11}$ remote from the zener diode are connected to the positive pole side of the supply voltage $V_2$, and the end of the capacitor C remote from the same is connected to the negative pole side.

This circuit device is of a system wherein the time, at which, at turn-on of the power source, the transistor $T_4$ turns on according to the time constant between the resistance $R_{11}$ and the capacitor C, is delayed so as to make the output of the IC logical circuit effective after satisfactorily stabilizing the supply voltage $V_2$, i.e., at point (*g*) indicated in FIG. 5 (2).

When the supply voltage $V_2$ has risen, it charges the capacitor C through the resistance $R_{11}$. When the charging voltage of the capacitor C has exceeded the voltage $V_z$ of the zener diode ZD, the transistor $T_4$ turns on. Depending on the values of the resistance $R_{11}$ and the capacitor C, accordingly, the period of time in which the transistor $T_4$ turns on, i.e., the point (*g*) of a one-dot chain line indicated in FIG. 5 (2) is reached can be freely adjusted.

At turn-off of the power source, the charges of the capacitor C are discharged to a load through the diode D. Therefore, the operation is the same as illustrated in FIG. 5.

As described above, according to this embodiment, malfunctions can be prevented more reliably at turn-on of the power source.

FIG. 7 shows another embodiment of the lock protective circuit 17. The operation of this circuit will be described with reference to FIG. 8 which illustrates the operations of the sewing machine at the normal running and at the lock.

At normal operation of the sewing machine, the drive signal DR and the output of a comparator $COM_2$, wherein the output of the lower position detector DD is inputted to the negative side of the comparator through a resistance $R_{18}$, are inputted to an AND gate $AND_4$.

During drive of the sewing machine, the drive signal DR becomes H to render the output of the comparator $COM_2$ effective. If the output of the comparator $COM_2$ is at H, the output of the AND gate $AND_4$ becomes H, and a capacitor $C_2$ is charged from the power source $V_2$ through a resistance $R_{19}$. During charging of the capacitor $C_2$, the voltage of the capacitor $C_2$ does not become greater than the gate voltage of a programmable unijunction transistor S (reference voltage $V_s$). Therefore, the transistor does not turn on.

When the transistor S is non-conductive, a transistor $T_{10}$ is also non-conductive. Therefore, the collector of the transistor $T_{10}$ becomes H, and the output $\overline{Q}$ of a flip-flop $FF_4$ is at H.

Further, if the output of the comparator $COM_2$ is at L, the output of the AND gate $AND_4$ becomes L, and the charges stored in the capacitor $C_2$ are discharged through a diode $D_2$ and the AND gate $AND_4$. At this time, therefore, the transistor S does not turn on and the collector of the transistor $T_{10}$ becomes H as in the foregoing.

Description will now be made of a case where, as illustrated in FIG. 8 (*b*), the sewing machine has fallen into the locked state at $t_L$.

During a period O - $t_L$, the normal operation is effected as stated previously. When the locked state has been established at $t_L$, the output of the lower position detector DD is zero, and the comparator $COM_2$ has a variable power source $V_v$ applied to its positive input, so that the output of the comparator $COM_2$ becomes $V_v$.

On the other hand, the drive signal DR is at H, the output of the AND gate $AND_4$ becomes H, the charging of the capacitor $C_2$ is continued, and the charging voltage thereof becomes greater than the gate voltage of the transistor S.

At this time, the transistor S becomes conductive, current flows to the base of the transistor $T_{10}$ through a resistance $R_{20}$, the transistor $T_{10}$ becomes conductive, and the collector potential thereof becomes L. Since the collector potential of the transistor $T_{10}$ is applied to the input of an inverter $INV_2$, the output of the inverter $INV_2$ is inputted to the S terminal of the flip-flop $FF_4$, the output $\overline{Q}$ of the flip-flop $FF_4$ becomes L.

When the output of the flip-flop $FF_4$ becomes L, the base-emitter circuit of the transistor $T_1$ is short-circuited through a diode $D_4$, so that the transistor $T_1$ for controlling the clutch coil CL becomes off.

On the other hand, the output of the inverter $INV_2$ is inputted to a one-shot multivibrator OM is operated to conduct the transistor $T_2$ Om. The one-shot multivibrator OM a fixed time and to brake the sewing machine.

If the sewing machine is locked in the state where the pedal is moved backward and the foot switch FSW is connected to the terminal *t*, then the thread cutting coil TR will operate. Since, however, the output $\overline{Q}$ of the flip-flop $FF_4$ is at L, the transistor $T_3$ is rendered non-conductive through a diode $D_5$, and the power supply to the thread cutting coil TR is cut off.

Subsequently, after removing the cause of the abnormality, the foot switch FSW is again moved frontward. Then, a signal enters from the terminal 1 to the reset terminal R of the flip-flop $FF_4$, and the output $\overline{Q}$ of the flip-flop $FF_4$ becomes H again, so that the lock protective circuit 17 returns to the original state.

The above period $t_{L-ts}$ is determined by the time constant between the resistance $R_{19}$ and the capacitor $C_2$ and the voltage of the variable power source $V_v$.

As described above, in accordance with this invention, when the sewing machine is locked, the motor is protected reliably and early, and burning-out of the thread cutting coil can be prevented by eliminating long time energization thereof.

Although, in the above embodiments, the output of the lower position detector DD has been employed for the detection of the speed, a speed generator may be similarly used as the speed detector. In particular, when the speed generator is used in the state in which it is attached to the machine shaft, the lock protective circuit reliably operates to effectively protect the sewing machine even in case where the machine malfunctions during its adjustments in the state in which it is turned over.

Further, although the malfunction in the case of the adjustments of the sewing machine under the turned over state has been stated in the above embodiments, the protective device operates, as in the foregoing, even in cases where the belt has severed, where the pulley has loosened and raced, etc.

As set forth above, according to this invention, when the rotation signal of the sewing machine shat has become below the reference signal, the stop signal is produced, and the drive signal and the thread cutting signal are made ineffective, so that the sewing machine and the personal operator can be reliably protected against malfunction of the sewing machine.

Furthermore, the control circuit is made ineffective at the rise and fall of the supply voltage for the IC logical circuit of the control circuit when the power source turns on and off, so that unstable operations can be prevented.

While we have shown and described several embodiments in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

We claim:

1. A protective device in a motor-operated sewing machine, comprising:

a motor, means for transmitting rotation of said motor to an output shaft through a clutch mechanism provided on a shaft of said motor, said clutch mechanism being actuated electromagnetically, and means for stopping said output shaft through a brake mechanism being actuated electromagnetically, means for transmitting rotation of said output shaft to a sewing machine shaft and drive said sewing machine shaft at a predetermined speed, electrical control means for electrically controlling said clutch mechanism and said brake mechanism in order to control rotation of said sewing machine shaft, means for detecting substantial rotation of said sewing machine shaft, and protector means for rendering the operation of said clutch mechanism ineffective through said control means when an output of the rotation detecting means has become lower than a reference value for driving the sewing machine shaft at said predetermined speed.

2. The protective device in a motor-operated sewing machine as defined in claim 1, wherein said protector means renders said brake mechanism operative for a short time at the same time that it brings said clutch mechanism into a released state.

3. The protective device in a motor-operated sewing machine as defined in claim 1, wherein said protector means renders operation of said clutch mechanism ineffective and simultaneously renders operation of an automatic thread cutting mechanism.

4. The protective device in a motor-operated sewing machine as defined in claim 1, wherein said detecting means for the substantial rotation of said sewing machine shaft is a position detector for detecting upper and lower positions of a sewing machine needle.

5. The protective device in a motor-operated sewing machine as defined in claim 1, wherein said detecting means is a speed generator which is mounted on said sewing machine shaft.

6. The protective device in a motor-operated sewing machine as defined in claim 1, wherein said protector means holds in an open state said means for controlling the rotation of the sewing machine shaft when the output of said detecting means is lower than the reference value.

7. A protective device in a motor-operated sewing machine, comprising:

a motor, means for transmitting rotation of said motor to an output shaft through a clutch mechanism provided on a shaft of said motor, said clutch mechanism being actuated electromagnetically, and means for stopping said output shaft through a brake mechanism actuated electromagnetically, means for transmitting rotation of said output shaft to a sewing machine shaft in order to drive the sewing machine shaft at a predetermined speed, electrical control means for electrically controlling said clutch mechanism and said brake mechanism in order to control rotation of said sewing machine shaft at said predetermined speed, and means for detecting substantial rotation of said sewing machine shaft, said electrical control means including IC logical circuits and protector circuit means for rendering ineffective outputs of the IC logical circuits other than that of said brake mechanism when a supply voltage for said control means is lower than a prescribed value, said protector circuit means having a semiconductor element having an operating voltage sufficiently lower than said prescribed value.

8. The protective device in a motor-operated sewing machine as defined in claim 7, wherein an automatic thread cutter mechanism is controlled by the IC logicl circuits.

9. The protective device in a motor-operated sewing machine as defined in claim 7, wherein said protector circuit means includes an IC logical circuit, and the output of said IC logical circuit is rendered ineffective by said semiconductor element when said supply voltage is lower than the prescribed value, and simultaneously, said brake mechanism is rendered operative by means of said semiconductor element.

10. The protective device in a motor-operated sewing machine as defined in claim 7, wherein said protector circuit means renders the outputs of said IC logical circuits ineffective for a predetermined time even after said prescribed value is exceeded by a rise of said supply voltage of said IC logical circuits.

* * * * *